US008156699B2

(12) United States Patent
LaSee

(10) Patent No.: US 8,156,699 B2
(45) Date of Patent: Apr. 17, 2012

(54) VISION PANEL FRAME

(76) Inventor: Jack C. LaSee, Abbotsford, WI (US)

( * ) Notice: Subject to any disclaimer, the term of this patent is extended or adjusted under 35 U.S.C. 154(b) by 2378 days.

(21) Appl. No.: 10/840,145

(22) Filed: May 6, 2004

(65) Prior Publication Data

US 2004/0226233 A1 Nov. 18, 2004

Related U.S. Application Data

(60) Provisional application No. 60/469,848, filed on May 13, 2003.

(51) Int. Cl.
*E06B 3/964* (2006.01)

(52) U.S. Cl. ..... 52/204.67; 52/204.62; 52/208

(58) Field of Classification Search ..... 52/204.64, 52/204.65, 204.67, 204.71, 204.72, 208, 52/476

See application file for complete search history.

(56) References Cited

U.S. PATENT DOCUMENTS

| | | | | | |
|---|---|---|---|---|---|
| 1,157,900 | A * | 10/1915 | Plym | 52/209 |
| 4,259,818 | A * | 4/1981 | Stark | 52/208 |
| 4,550,542 | A * | 11/1985 | La See | 52/476 |
| 5,207,044 | A * | 5/1993 | LaSee | 52/476 |
| 5,987,826 | A * | 11/1999 | Petta | 52/204.5 |
| 2003/0066256 | A1 * | 4/2003 | DeBlock et al. | 52/208 |

* cited by examiner

*Primary Examiner* — William Gilbert
(74) *Attorney, Agent, or Firm* — Boyle Fredrickson, S.C.

(57) ABSTRACT

An improved vision panel provides a nail in retention method for holding half the panel in place during installation using inwardly extending retention arms that also provide threaded fasteners for attaching the halves of the frame together about the door, support for the glass pane, and when used with special fasteners having partially non-threaded shanks, a compression limiting spring biasing of the frame elements together.

14 Claims, 3 Drawing Sheets

VISION PANEL FRAME

CROSS-REFERENCE TO RELATED APPLICATIONS

This application is based on provisional application 60/469,848 filed May 13, 2003 and entitled "Vision Panel Frame for Fire Door", and claims the benefit thereof.

STATEMENT REGARDING FEDERALLY SPONSORED RESEARCH OR DEVELOPMENT

--

BACKGROUND OF THE INVENTION

This invention relates generally to a vision panel providing a window in a fire door. More particularly, the present invention provides a vision panel providing simplified assembly.

Vision panels for fire doors provide a window through the fire door that preserves the integrity of the fire door by retaining an approved wire glass even after prolonged exposure to fire and possible thermal shock caused by the glass being sprayed with a fire hose after heating.

Currently available vision panels provide frame halves that may fit into the opening of the door from either side of the door. The frame halves have flanges which abut the front and rear faces of the door and inner sash members extending in from the flanges and which come together about a pane of glass to support the glass therebetween. Assembly of the vision panel can require two people, one to hold one frame half against one side of the door, while the second person from the other side of the door positions the glass and installs screws holding the frame halves together. In some designs the screws must pass through the door itself requiring accurate drilling of holes and raising the risk of splintering the door skin material.

U.S. Pat. No. 4,550,542, filed Aug. 9, 1984, and assigned to the assignee of the present invention and hereby incorporated by reference, describes an improved vision panel frame providing simplified installation by using bolts passing wholly through the precut window opening and a spring clip that may be used to hold one-half of the frame in position while the installer works from the other side of the door.

The spring clip in the '542 patent has a finger at one end engaging a portion of a sash member of the frame half to be retained, and a hook at the other end that may grip the edge of the window opening cut in the door opposite the installed frame. A second frame half is then installed over this hook covering it from view.

Care must be taken when tightening the screws holding the frame together to provide sufficient force to compress the sash against the glass so that should the glass become molten, the edges of the sash will embed themselves in the glass to hold it in position. Too much force in tightening the screws holding the frame together, however, can distort the metal frame halves.

Separate support elements may be placed underneath the glass pane during installation to support it above the lower sill of the opening centered within the sash plates.

BRIEF SUMMARY OF THE INVENTION

The present invention provides a number of improvements over the above-described vision panel that greatly simplify assembly, reduce the number of parts that an installer must contend with, and provides superior control over the compressive force with which the glass is held reducing the chance of mis-installation or distortion of the frame unit.

More specifically, the present invention provides a fire resistant vision panel for assembly in an opening passing through a door, the vision panel, including first and second flanges sized to frame the opening on either side of the door, and sash elements extending into the opening from each of the first and second flanges to capture a transparent pane therebetween. At least one retention member is attached to the first flange and extends into the opening to grip a sill surface of the opening to retain thereby the first flange and its sash element in position for assembly. At least, one fastener is adapted to draw the first and second flanges and the sash elements together against the pane.

Thus it is one object of at least one embodiment of the invention to simplify installation by eliminating the need for the installer to have a helper holding the flange on one side of the door while the flange on the other side of the door is installed or the need to contend with a separate spring clip.

It is yet another object of at least one embodiment of the invention to provide a retention member that may attach directly to the flange rather than to a face of the door, so as to provide a lower profile frame that does not need to accommodate a hook or the like.

The retention member may have a hole in its inner end and may include a nail adapted to pass through the hole into a core material of the sill surface.

It is thus another object of at least one embodiment of the invention to provide a positive engagement of the frame and the sill surface that readily resists accidental dislodgement.

It is yet another object of at least one embodiment of the invention to provide an engagement method that may be installed using commonly available tools and intuitive fastening methods.

The second flange may include at least one hole for receiving the fastener therethrough and the retention member may further include a socket receiving an end of the fastener after it has passed through the hole.

Thus, it is another object of at least one embodiment of the invention to provide that the retention member perform double duty, both to hold the first frame in place, and to provide a point of attachment between the two frame elements.

It is another object of at least one embodiment of the invention to provide a simple method of eliminating fastener holes on the first frame portion by displacing the fastener receiving holes into the interior of the frame.

It is another object of at least one embodiment of the invention to shorten the length of necessary fasteners and, hence, their difficulty in alignment of the fastener and holes by moving the point of attachment for the fastener toward the face of the door.

The socket may be attached to the retention member by a spring element allowing movement of the socket toward the second flange against a spring biasing force.

Thus, it is another object of at least one embodiment of the invention to provide a spring-like compression between the frame halves such as improve the retention of the glass in normal and molten state.

The spring element may be a cantilever tab extending across the axis of the threaded fastener that deflects with increasing engagement of a threaded fastener.

It is thus another object of at least one embodiment of the invention to provide an extremely simple mechanism for providing the necessary spring biasing in flexure of the tab.

The threaded fastener may include a non-threaded section limiting the engagement of the threaded fastener with the socket.

It is thus another object of at least one embodiment of the invention to provide a simple method of avoiding over compression of the frame halves while ensuring sufficient compression is obtained. The installer simply turns the threaded fastener until the socket has been drawn wholly off of the threaded portion of the fastener, providing the necessary compressive force, but limiting further compression.

These particular objects and advantages may apply to only some embodiments falling within the claims and thus do not define the scope of the invention.

DETAILED DESCRIPTION OF THE PREFERRED EMBODIMENT

Figure 1:
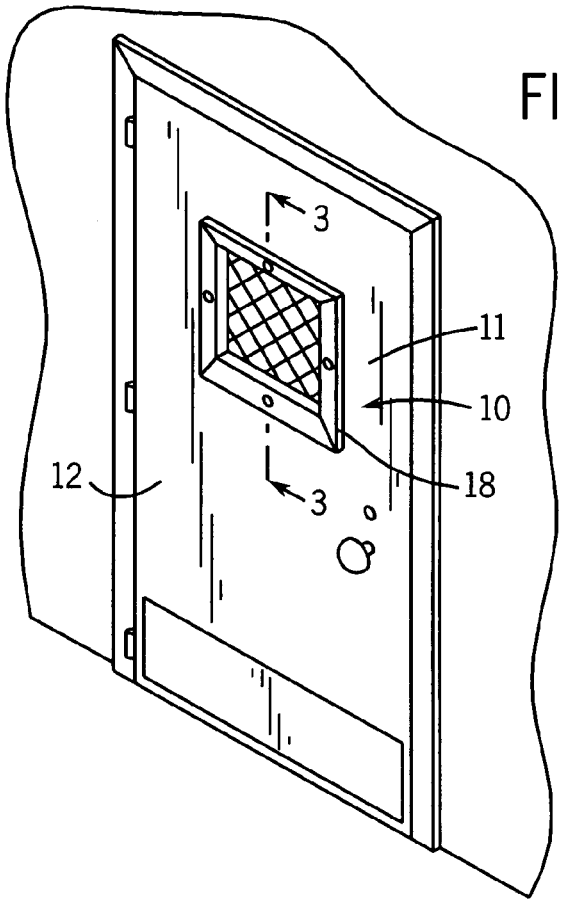
FIG. 1 is a view in perspective showing the vision panel in a typical fire door installation.
Figure 2:
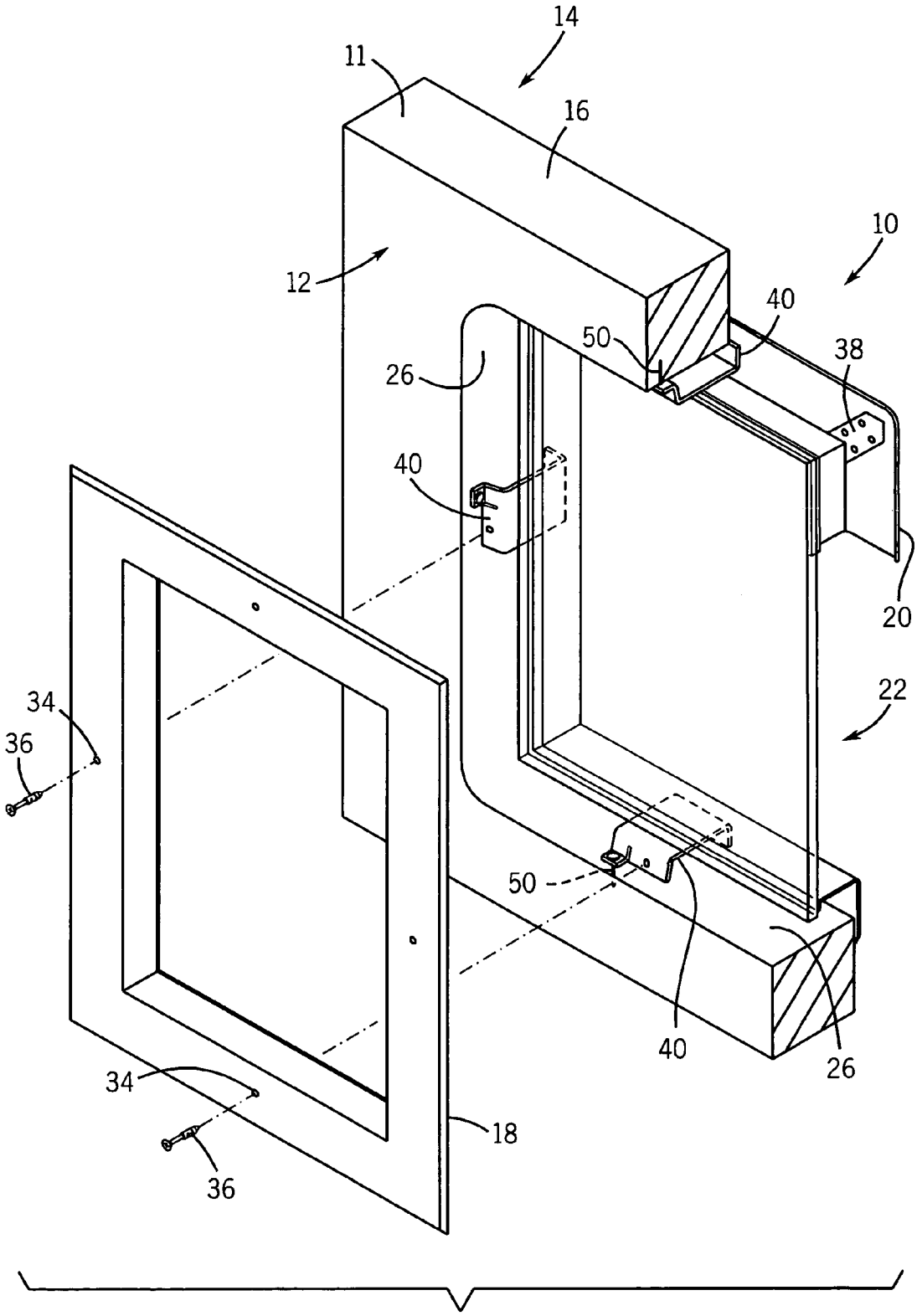
FIG. 2 is an exploded fragmentary perspective view of the vision panel as it is assembled in the opening of the door showing retention members used to retain frame halves of the vision panel during the installation process.

Referring now to FIGS. 1 and 2, the vision panel 10 of the present invention may be used with a conventional fire door 11; the fire door having a front face 12 and rear face 14 typically composed of a skin material such as a wood or steel panel sandwiching a core material 16 which may, for example, be honeycombed paper, foam, composite board, or cementations material.

The vision panel 10 includes a front frame half 18 and rear frame half 20, respectively, that may fit within an opening 22 that is generally rectangular in shape having been cut through the front face 12, the core material 16, and the rear face 14. The opening 22 defines four sill surfaces 26 formed by the core material 16 and positioned at a top, bottom, left, and right of the opening 22.

Figure 3:
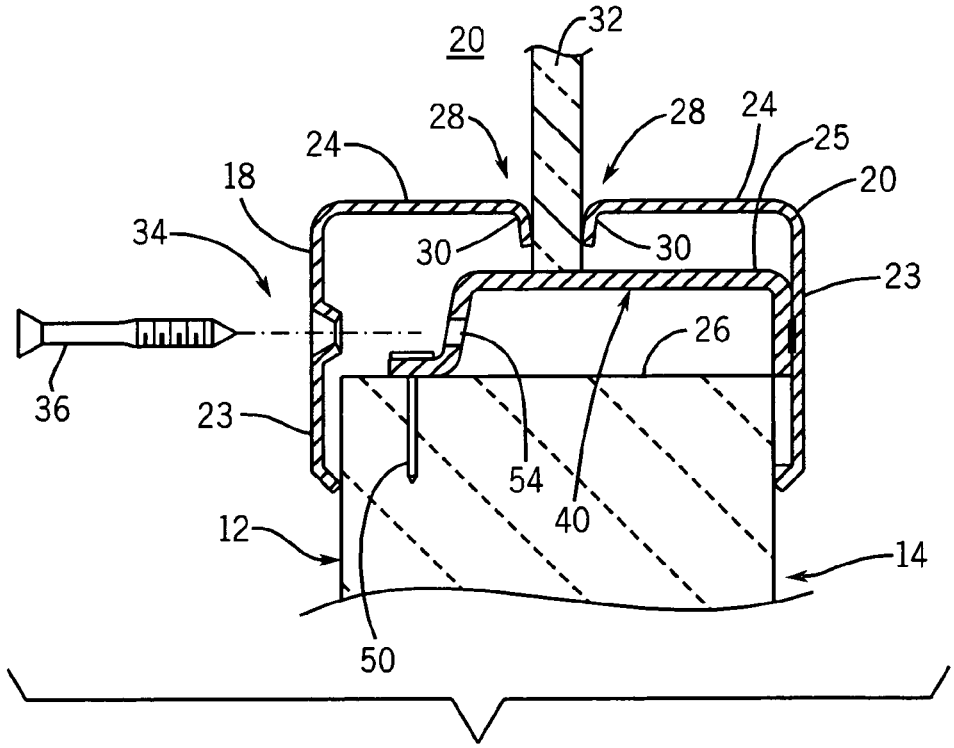
FIG. 3 is a cross sectional view taken along lines 3-3 of FIG. 1 of a lower sill area of an opening in the door showing the elements of the frame halves and the retention member in position per FIG. 2.

Referring now to FIGS. 2 and 3, each of front frame half 18 and rear frame half 20, include flanges 23 which abut the front face 12 and rear face 14, respectively, to frame the opening 22 on either side. The flanges 23 may, for example, be eighteen or twenty gauge sheet metal and covered with veneer, paint or polyester powder coating, or may be stainless steel.

Extending into the opening 22 at the inner edge of the front frame half 18 and rear frame half 20 are sash elements 24.

Opposed inner edges of the sash elements 24 terminate in finger portions 28 having sharp edges 30 which press inward against either side of a pane glass 32 as is described in U.S. Pat. No. 4,550,542. Softening of the glass 32 during a fire allows the edges 30, under proper compression, to embed themselves in the glass 32 preventing the glass 32 from falling out. The glass 32 may be a quarter inch wire glass panel or other transparent material. No glazing compound, tape, or intumescent is required.

Flanges 23 of front frame half 18 include holes 34 centered along each side of the front frame half 18 formed by the flanges 23 within the perimeter of the opening 22 thus allowing free passage of threaded fasteners 36 therethrough into the opening 22 to engage portions of the rear frame half 20 as will be described below. Threaded fasteners 36 may be one-way fasteners or other tamper proof designs.

The flanges 23 and sash element 24 may be folded from a single strip of material, miter cut, and attached by weldments 38 shown in FIG. 2 at the corners to provide a rugged single unit for assembly.

Referring now to FIG. 3, a retention arm 40 may attach at an inner surface of the flanges 23 of the rear frame half 20 by spot welding or the like at midpoints along the length of each flange 23 opposite the holes 34 of the front frame half 18. The retention arm 40 may be folded from sheet metal, and when spot welded to the inner surface of the flanges 23, adds a thickness less than required by a hook retention system allowing flanges 23 of front frame half 18 and rear frame half 20 to more closely conform to the front face 12 and rear face 14 of the door providing an extremely low profile vision panel 10.

Figure 4:
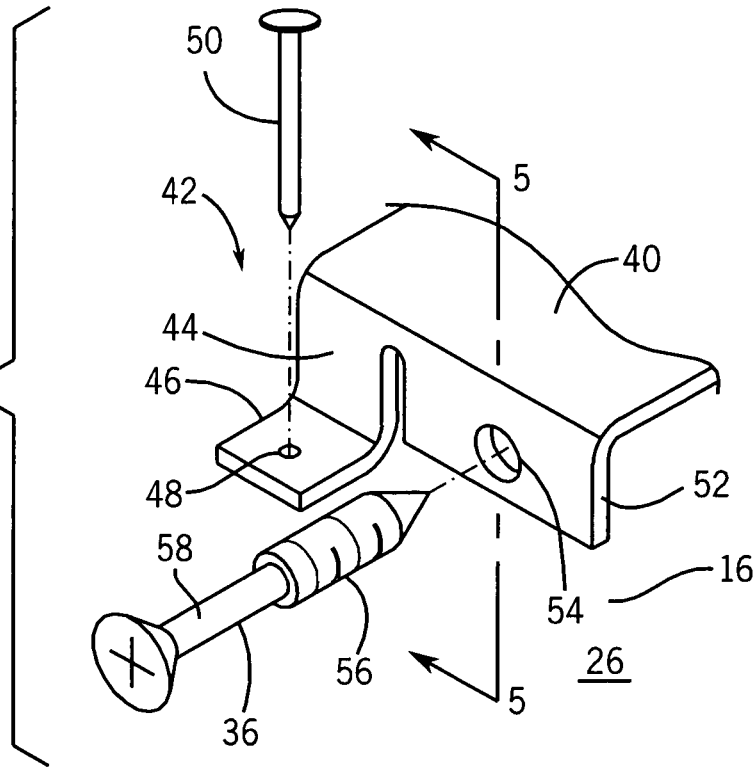
FIG. 4 is a fragmentary perspective view of the inner end of the retention member showing portions that allow for holding the retention member against the sill and for receiving the threaded fasteners which attach the frame halves together.

Referring to FIGS. 3 and 4, the retention arms 40 may extend into the opening 22 between the sash element 24 and the sill surfaces 26 providing on centrally facing surfaces a ledge 25 supporting edges of the glass 32 to center the glass 32 within the opening 22. A distal end 42 of the retention arm 40 removed from rear frame half 20 provides a foot element 44 extending from the distal end 42 toward the sill surface 26 and providing a foot 46 abutting the sill surface 26 and having a hole 48 therethrough. The foot 46 supports the ledge 25 of the retention arm 40 to remain essentially parallel to the sill surface 26.

A nail 50 may be used to fasten the foot 46 to the core material 16 of the sill surface 26 preventing movement of the foot 46 along the sill surface 26 such as would allow the rear frame half 20 to slip out of the opening 22. Note that the nail 50 need only resist this sliding motion and, thus, need not be retained strongly against removal from the core material 16. Nails 50 may be installed in each of the retention arms 40 or any opposed pair of retention arms 40.

The distal end 42 of the retention arm 40 also includes a downwardly extending tab 52 that does not contact the sill surface 26 to any substantial degree but is held in cantilevered fashion from the remainder horizontal portion of retention arm 40. This tab 52 includes a threaded hole 54 which may be pre-threaded or threaded by a self-tapping action of threads 56 of the threaded fasteners 36.

Referring to FIGS. 2 and 4, the front frame half 18 and rear frame half 20 may be retained together by the threaded fasteners 36 having their threaded portions engaging holes 54 in corresponding retention arms 40 positioned opposite each of the holes 34 with the heads of the threaded fasteners 36 exposed through the flanges 23 of front frame half 18 and capturing the front frame half 18 beneath them.

Figure 5:
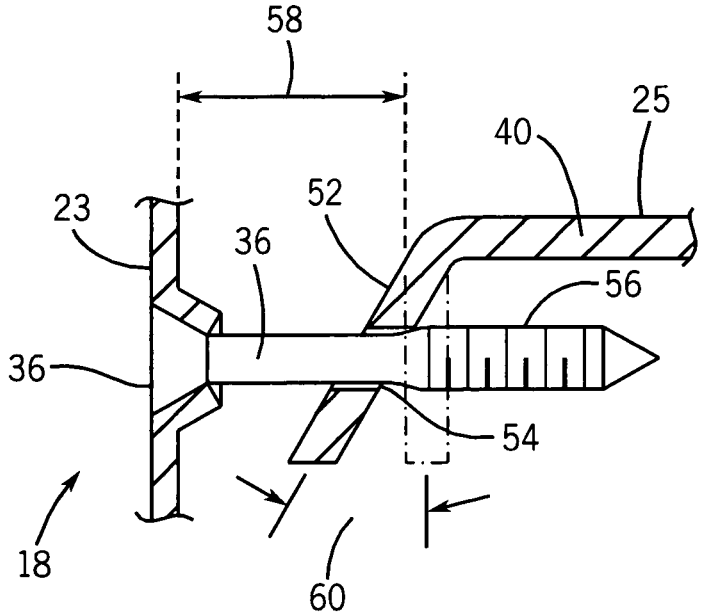
FIG. 5 is a cross-sectional view taken along line 5-5 of FIG. 4 showing flexure of a tab of the retention member receiving the threaded fastener such as limits compressive forces.

Referring now to FIG. 5, the threaded fasteners 36 include a non-threaded portion 58 between the head and the threads 56. Tightening the threaded fastener 36 causes a flexure of the tab 52 toward the front frame half 18 causing the threaded portion of the hole 54 to move onto the non-threaded portion 58 preventing further tightening of the front frame half 18 and rear frame half 20. The flexure 60 of the tab 52, nevertheless, provides a continual spring biasing of the front frame half 18 and rear frame half 20 together.

It is specifically intended that the present invention not be limited to the embodiments and illustrations contained herein, but include modified forms of those embodiments including portions of the embodiments and combinations of elements of different embodiments as come within the scope of the following claims.

I claim:

1. A fire resistant vision panel for assembly in an opening passing through a door, the vision panel comprising:

a first and second flange unit each comprising a rectangular frame sized to frame the opening and abut a front and rear face of the door; the rectangular frames of the flange units each having four sides attached at corners by welds;

sash elements adapted to extend into the opening from each of the first and second flange units to capture a transparent pane therebetween within the opening;

at least one retention member attached to the first flange unit and extending into the opening beyond a position of the transparent pane with respect to the first flange unit when positioned between the sash elements to grip a sill surface of the opening thereby to retain the first flange unit and its sash element in position for assembly the retention member having an end unobstructed by the first flange unit when the first flange unit is in position for assembly;

a spike positioned on the first end to affix the first end to a core material of a sill surface of the opening to retain the retention member in the opening wherein the spike is sized, oriented and positioned to be driven into the core material by impact of a hammer; and at least one fastener adapted to draw the first and second flange units and the sash elements together against the pane; and wherein the sash elements include flanges extending generally parallel to the transparent pane when captured therebetween, ends of the flanges flexing to provide inwardly spring-biased sharp edge portions in contact with said pane wherein said sharp edge portions will embed in said pane to grip the pane when said pane becomes semi-molten in fire.

2. The vision panel of claim 1 wherein the spike is a nail passing through a hole in the end into a core material of a sill surface of the opening to retain the retention member in the opening.

3. The vision panel of claim 1 wherein the fastener is a threaded fastener and wherein the second flange unit includes at least one hole for receiving the threaded fastener therethrough and wherein the retention member further includes a socket threadably receiving an end of the threaded fastener after it has passed through the hole.

4. The vision panel of claim 3 wherein the socket is attached to the retention member by a spring element allowing movement of the socket toward the second flange unit against a spring force bias.

5. The vision panel of claim 4 wherein the spring element is a cantilevered tab extending across an axis of the threaded fastener to flex with increased engagement of the threaded fastener.

6. The vision panel of claim 3 wherein the threaded fastener includes a non-threaded section limiting an engagement of the threaded fastener with the socket.

7. The vision panel of claim 1 wherein the opening is generally rectangular having four pairwise opposed sill surfaces and wherein the vision panel includes four retention members attached to the first flange unit and extending into the opening to grip each of the respective four sill surfaces.

8. The vision panel of claim 1 wherein a surface of the retention member support edges of the pane.

9. A fire resistant vision panel for assembly in an opening through a door, the vision panel comprising:

a first and second flange unit sized to frame the opening and abut front and rear faces of the door;

sash elements adapted to extend into the opening from each of the first and second flange units to hold a transparent pane therebetween within the opening;

at least one spring member attached to the first flange unit and extending into the opening to support on a cantilevered tab, a threaded socket spring-biased toward the first flange unit along a direction therethrough the opening; and a threaded fastener adapted to engage the second flange unit and the threaded socket to draw the first and second flange units and the sash elements together against the pane wherein the threaded fastener includes a head and a shank and wherein the shank includes a non-threaded section between the head and a threaded section, the non-threaded section limiting a depth of engagement of the threaded fastener with the threaded socket at a point where a threaded portion of the threaded socket is drawn over the non-threaded section to substantially disengage with the fastener threads as the threaded fastener is advanced;

wherein the limited depth of engagement provides a predetermined compressive force of the sash elements against the pane.

10. The vision panel of claim 9 wherein the cantilevered tab is attached to the first flange unit extending into the opening, wherein the tab extends across an axis following a length of the threaded fastener to flex with increased engagement of the threaded fastener.

11. The vision panel of claim 9 wherein the vision panel includes four retention members attached to the first flange unit and extending into the opening to support separate four threaded sockets.

12. The vision panel of claim 11 wherein the second flange has four holes for receiving threaded fasteners to engage the four threaded sockets.

13. The vision panel of claim 12 wherein the upper surface of the retention members supports the bottom of the transparent pane.

14. The vision panel of claim 9 wherein the sash elements include inwardly biased sharp edge portions in contact with said panel member wherein said sharp edge portions will embed in said panel member when said panel becomes semi-molten.

* * * * *